US006726607B1

(12) United States Patent
Ihli

(10) Patent No.: US 6,726,607 B1
(45) Date of Patent: Apr. 27, 2004

(54) PORTABLE PERSONAL TRAINING AND EXERCISE DEVICE WITH A CABLE AND PULLEY MECHANISM

(76) Inventor: Stephen P. Ihli, 423-D San Vicente Blvd., Santa Monica, CA (US) 90402

( * ) Notice: Subject to any disclaimer, the term of this patent is extended or adjusted under 35 U.S.C. 154(b) by 55 days.

(21) Appl. No.: 10/174,670

(22) Filed: Jun. 18, 2002

(51) Int. Cl.[7] ..... A63B 21/045

(52) U.S. Cl. ..... 482/127; 482/126; 482/121; 482/122; 482/123; 482/130; 482/142; 482/118; 482/115; 482/907; 482/92

(58) Field of Search ..... 482/127, 126, 482/121–123, 130, 142, 118, 115, 907, 92, 129, 908

(56) References Cited

U.S. PATENT DOCUMENTS 1,390,095 A * 9/1921 Dettinger
4,625,962 A * 12/1986 Street
4,948,119 A * 8/1990 Robertson ..... 482/127
5,324,243 A * 6/1994 Wilkinson ..... 482/92
5,755,646 A * 5/1998 Chu

* cited by examiner

*Primary Examiner*—Jerome W. Donnelly
(74) *Attorney, Agent, or Firm*—Thomas I. Rozsa; Tony D. Chen

(57) ABSTRACT

A portable personal training and exercise device having a base assembly, a pole assembly and cable and pulley assembly. The base assembly has a tilt mechanism for holding the pole assembly in different orientations. The cable and pulley assembly is attached to the pole assembly and has two coaxial pulleys rotatably mounted on a common single stationary shaft. Each pulley is spring biased for rewinding a cord onto the pulley. The cable and pulley assembly also has a tension adjustment unit for adjusting the resistance of the pulleys, and two multi-direction guide units mounted on the housing of the cable and pulley assembly for allowing the pulley cords to be pulled in multiple directions with reduced friction. A user may pull the cords of the pulleys for exercising various muscles of the user and adjust the resistance force of the cords at an appropriate level suitable to the user.

32 Claims, 9 Drawing Sheets

PORTABLE PERSONAL TRAINING AND EXERCISE DEVICE WITH A CABLE AND PULLEY MECHANISM

BACKGROUND OF THE INVENTION

1. Field of the Invention

The present invention relates generally to the field of sport and exercise devices and more particularly relates to a portable personal training and exercise device which utilizes a cable and pulley mechanism.

2. Description of the Prior Art

In recent years personal training and exercise devices have become very popular among the general public. Many different types of personal training and exercise devices including fixed, stationary and portable types, have been designed and introduced by various manufacturers. However, existing personal training and exercise devices are often cumbersome, expensive or difficult to operate and maintain.

It is always desirable to provide a new design and construction of a portable personal exercise device that can provide various exercise options with a wide range of resistance. It is also desirable to provide a new design and construction of a portable personal exercise device that utilizes a cable and pulley mechanism which is easy to operate and maintain. It is further desirable to provide a new design and construction of a portable personal exercise device that is compact, lightweight, and relatively inexpensive.

SUMMARY OF THE INVENTION

The present invention is directed to a portable personal training and exercise device with a cable and pulley mechanism.

It is an object of the present invention to provide a new and unique design and construction of a portable personal exercise device that can provide various exercise options with a high degree of variation in the resistance provided to the user.

It is also an object of the present invention to provide a new and unique design and construction of a portable personal exercise device that utilizes a cable and pulley mechanism that is easy to use and maintain.

It is a further object of the present invention to provide a new and unique design and construction of a portable personal exercise device that is compact in size, lightweight, and costs relatively less to produce.

In a preferred embodiment of the present invention, the portable personal training and exercise device has a base assembly, a pole assembly and a cable and pulley assembly. The base assembly has two parallel main platforms and a tilt mechanism for holding a pivotally mounted base tube in different orientations including at least a vertical orientation. The pole assembly includes one extension pole and one attachment pole and connection sleeves for interconnecting the poles and also to the base tube of the base assembly. The cable and pulley assembly has a housing mounted on the attachment pole of the pole assembly for housing a cable and pulley mechanism therein. The cable and pulley mechanism has two coaxial pulleys rotatably mounted on a common single stationary shaft, each spring biased for rewinding a cord onto the pulley. The cable and pulley assembly also includes a tension adjustment unit with an adjustment knob for adjusting the resistence of the pulleys from outside of the housing of the cable and pulley assembly. A user may pull the cord of the pulleys for exercising various muscles of the user and adjust the resistence force of the cord at an appropriate level suitable to the user.

The present invention has many novel and unique features and advantages. It provides a new design and construction of a portable personal exercise device that offers a wide range of exercise options with a high degree of variation in resistance provided to its user. It also provides a new design and construction of a portable personal exercise device that utilizes a cable and pulley mechanism which is easy to operate and is also easy to maintain. It further provides a new design and construction of a portable personal exercise device that is light in weight, compact in size, and low in cost.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

As a brief introduction, the present invention portable personal training and exercise device has a base assembly, a pole assembly and a cable and pulley assembly.

The base assembly has two parallel main platforms and a tilt mechanism assembled between and interconnecting the two parallel main platforms, where the tilt mechanism has a pair of tile plates held upright in a spaced apart parallel relationship with a base tube pivotally mounted therebetween. Each tilt plate has a semi-circular upper rim with multiple notches located at different degrees, and a tilt lever mounted on the base tube for moving a locking pin which can engage with the notches on the upper rims of the tilt plates for locking the base tube in different orientations including at least a vertical orientation.

The pole assembly includes an extension pole, an attachment pole with attachment holes at regular intervals, and two connection sleeves for connecting the extension pole to the base tube of the base assembly and connecting the attachment pole to the extension pole.

The cable and pulley assembly has a housing mounted on the attachment pole of the pole assembly for housing a cable and pulley mechanism therein, which has two coaxial pulleys stacked around a common single stationary shaft. Each pulley is mounted on a gear hub and has a clock spring attached on one side of the pulley for rewinding a cord onto the pulley and a brake wheel attached on the opposite side of the pulley for resisting the rotation of the pulley.

The cable and pulley assembly also has a tension adjustment unit with an adjustment knob for adjusting the resistance of the pulleys from outside of the housing of the cable and pulley assembly. The cable and pulley assembly further includes two multi-direction guide units mounted on the housing of the cable and pulley assembly for allowing the pulley cords to be pulled in multiple directions with reduced friction. A user may pull the cord of the pulleys for exercising by 14 various muscles of the user and adjust the resistance force of the cord at an appropriate level suitable to the user.

Figure 1:
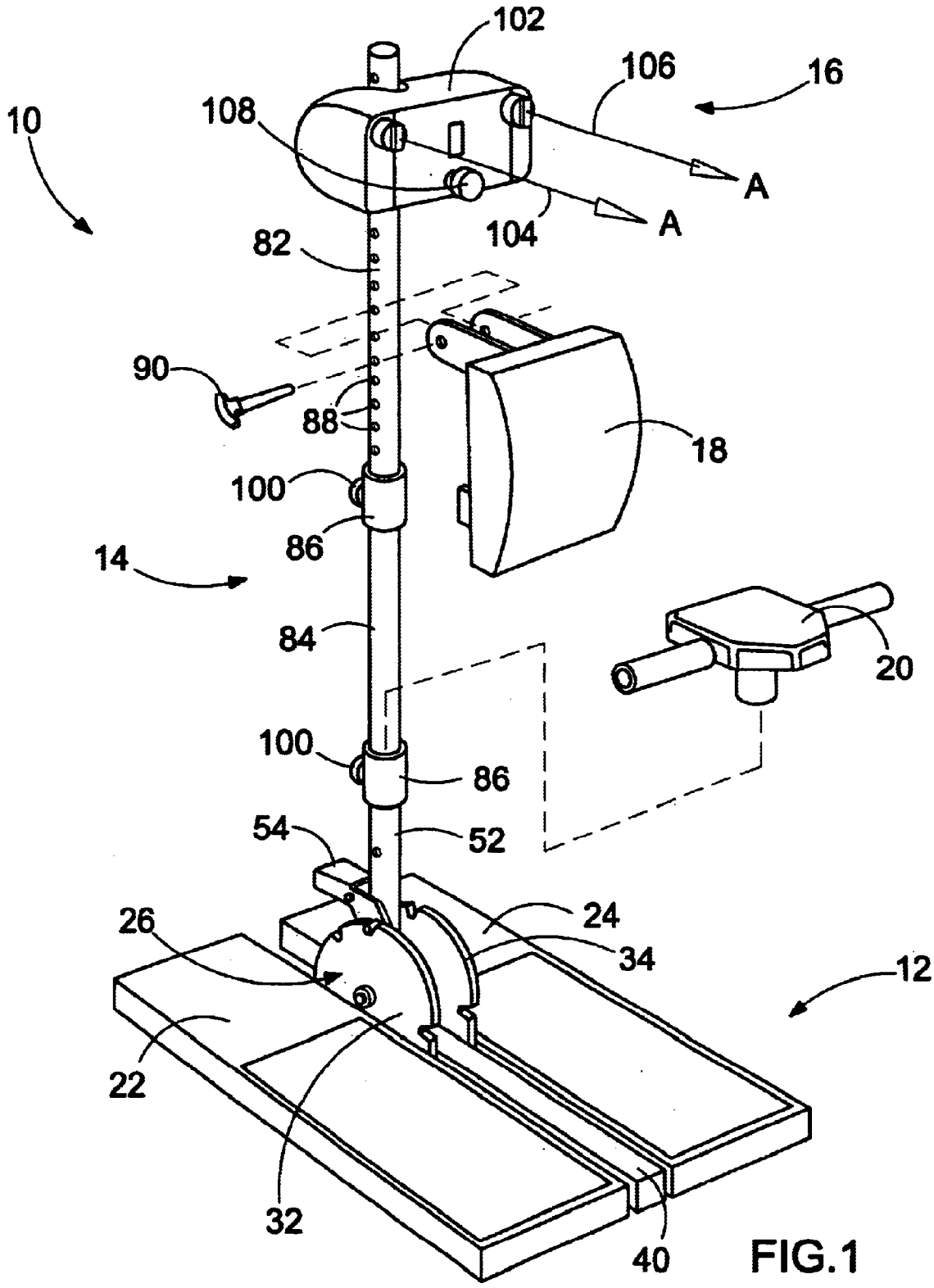
FIG. 1 is an illustrative perspective view of a preferred embodiment of the present invention portable personal training and exercise device with a cable and pulley mechanism.

Referring to FIG. 1, there is shown a preferred embodiment of the present invention portable personal training and exercise device 10. The portable personal training and exercise device 10 has a base assembly 12, a pole assembly 14, and a cable and pulley assembly 16.

Figure 2:
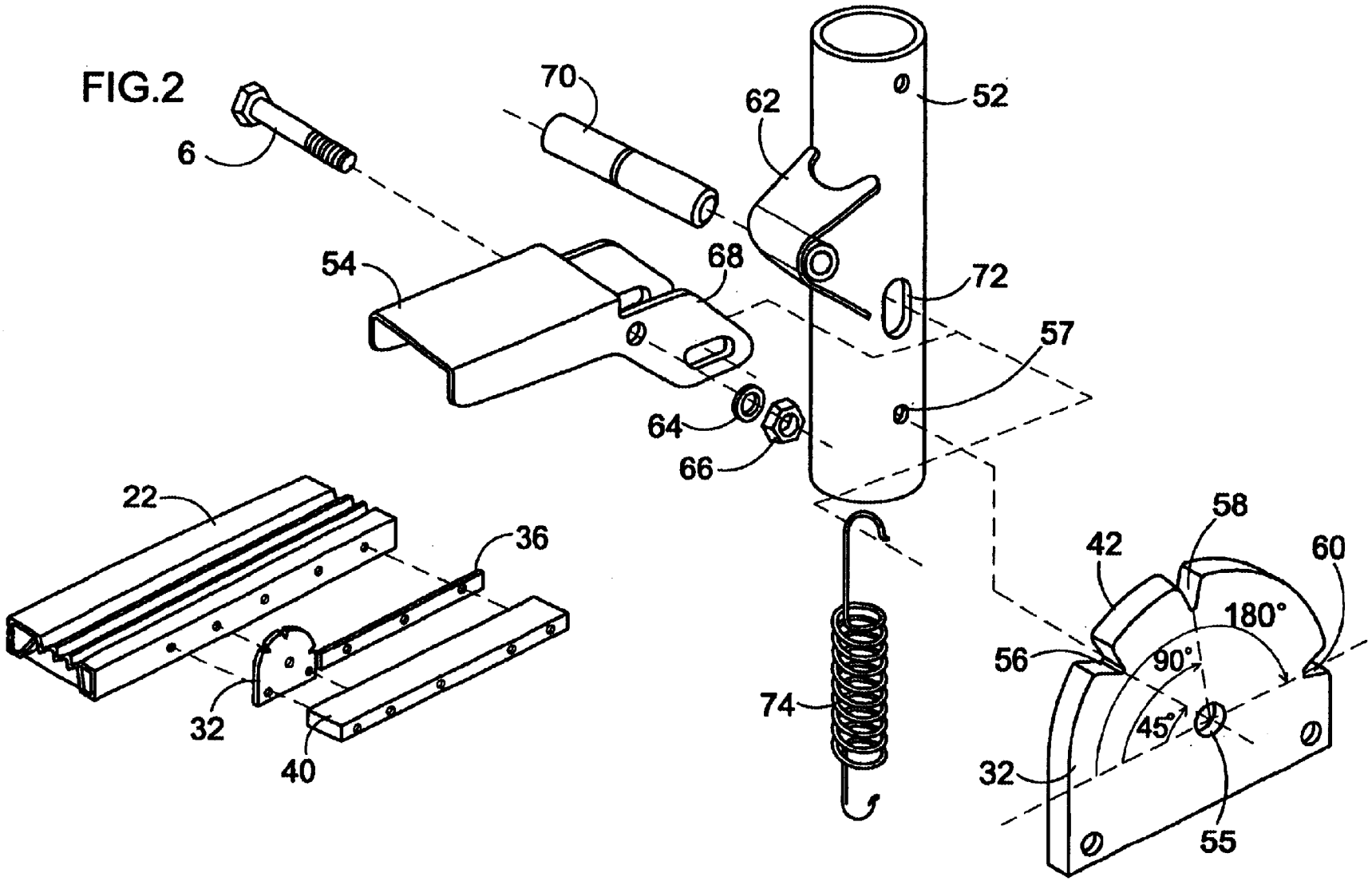
FIG. 2 is an exploded illustrative perspective diagram of the base assembly and tilt adjustment mechanism of the present invention portable personal training and exercise device with a cable and pulley mechanism.
Figure 3:
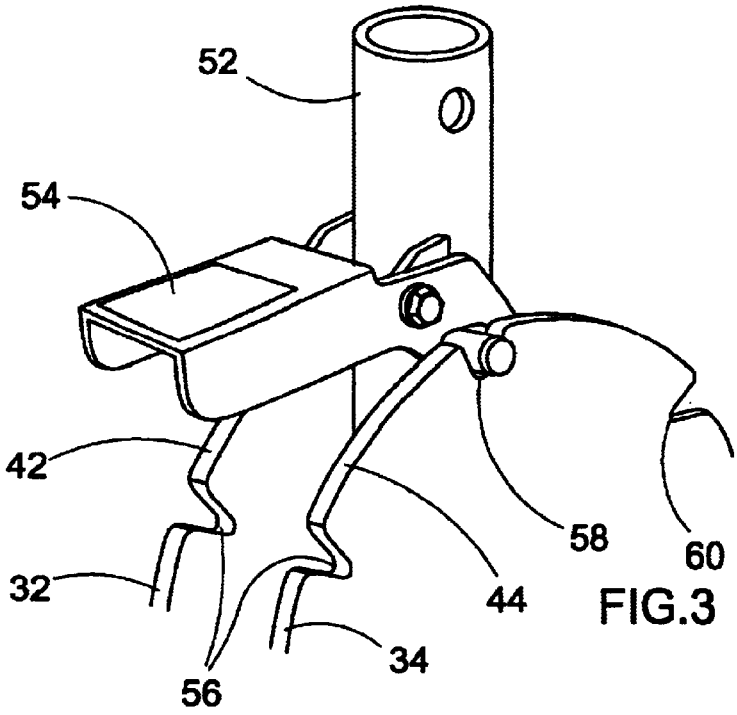
FIG. 3 is an enlarged illustrative perspective diagram showing the tilt lever, locking pin and tilt plates engagement of the present invention portable personal training and exercise device with a cable and pulley mechanism.

Shown in FIGS. 1, 2 and 3, the base assembly 16 includes two parallel main platforms 22 and 24, and a tilt mechanism 26 assembled between and interconnecting the two parallel main platforms 22 and 24. The two main platforms 22 and 24 can be used by a user to rest his or her feet thereon, one for each foot, or used by the user as a kneeling or sitting platform when using the portable personal training and exercise device 10 in alternative manners.

The tilt mechanism 26 includes a pair of tilt plates 32 and 34, two spacer strips 36 and 38 (only one is shown), and a narrow center platform 40. When assembled, one tilt plate 32 and one spacer strip 36 are sandwiched between one main platform 22 and the center platform 40, and the other tilt plate 34 and the other spacer strip 38 are sandwiched between the other main platform 24 and the center platform 40, such that the pair of tilt plates 32 and 34 are held upright in a spaced apart parallel relationship, and the center platform 40 fills the narrow gap between the two main platforms 22 and 24.

The two tilt plates 32 and 34 each has a generally semi-circular disc shaped configuration. When assembled between the two main platforms 22 and 24, the straight bottom of the two tilt plates 32 and 34 are flush with the bottoms of the two main platforms 22 and 24 and the center platform 40. The semi-circular upper rims 42 and 44 of the two tilt plates 32 and 34 each has three (3) notches 56, 58 and 60 approximately located at 45°, 90° and 180° angles, respectively (as shown in FIG. 2).

The tilt mechanism 26 also includes a base tube 52, and a tilt lever 54 mounted on the base tube 52 for adjusting the tilt angle of the base tube 52. The base tube 52 is assembled between the two tilt plates 32 and 34 with its bottom end located adjacent to the center of the two tilt plates 32 and 34, with a fastener bolt (not shown) inserted through the center holes 55 of the two tilt plates 32 and 34 and a bottom end hole 57 of the base tube, such that the base tube 52 can be rotated about the fastener bolt and titled at various angles.

The tilt lever 54 is mounted on the base tube 52 with a pivot bolt 60 inserted through a bushing that is mounted on the outside of the base tube 52. The pivot bolt 61 is secured by a pair of washers 64 and a fastener nut 66.

At the proximal end 68 of the tilt lever 54, a locking pin 70 is inserted through an elongated slot 72 on the base tube 52 which allows the locking pin 70 to move along the longitudinal direction of the base tube 52.

An extension spring 74 located within the base tube 52 is used to pull the locking pin 70 towards the bottom of the base tube 52. One end of the extension spring 74 is hooked on the locking pin 70, and the other end of the extension spring 74 is hooked on the bottom end of the base tube 52. When the base tube 52 is titled at one of the aforementioned angles such that it aligns with one of the notches 56, 58 and 60, the locking pin 70 will be pulled by the spring 74 into one of the notches 56, 58 and 60 which in turn secures the base tube 52 at that angle. By pressing down the tilt lever 54, the locking pin 70 will be lifted up and move out of the notch, which allows the tilt angle of the base tube 52 to be adjusted to another degree.

Referring again to FIG. 1, the pole assembly 14 of the present invention portable personal training and exercise device 10 include an attachment pole 82, an extension pole 84, and a pair of connection sleeves 86. The extension pole 84 is connected to the base tube 52 of the base assembly 12 by a connection sleeve 86, and the attachment pole 82 is connected to the extension pole 84 by another connection sleeve 86. The attachment pole 82 has holes 88 at regular intervals for attaching the cable and pulley assembly 16 at a desired height. In the figures, the arrows "A" indicate one of the many directions that the cables may be pulled towards during the operation of the present invention portable personal training and exercise device 10.

The present invention portable personal training and exercise device 10 may further include a body support 18 and a seat 20. The body support 18 can be attached to the attachment pole 82 by a fastener bolt 90 for providing support to a part of a user's body (such as lower back) when the present invention portable personal training and exercise device 10 is used in the upright position as the user stands on the main platforms 22 and 24 of the base assembly. The use of the seat 20 will be described later.

Figure 4:
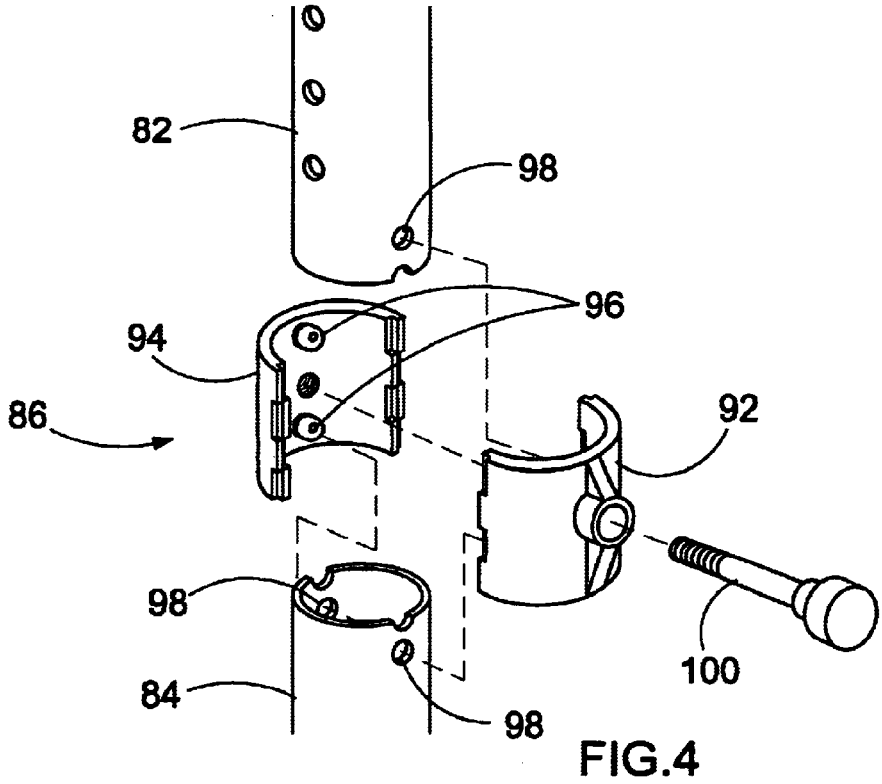
FIG. 4 is an exploded illustrative perspective diagram showing the connecting sleeve of the pole assembly of the present invention portable personal training and exercise device with a cable and pulley mechanism.

Referring to FIG. 4, there is shown an example of the structure of the connection sleeve 86. It may include two half-sections 92 and 94 with internal pegs 96 which are engaged with the end holes 98 of the attachment pole 82 and the extension pole 84. The two half-sections 92 and 94 can be fastened together by a fastener bolt 100 to join-the adjacent ends of the attachment pole 82 and the extension pole 84.

Figure 5:
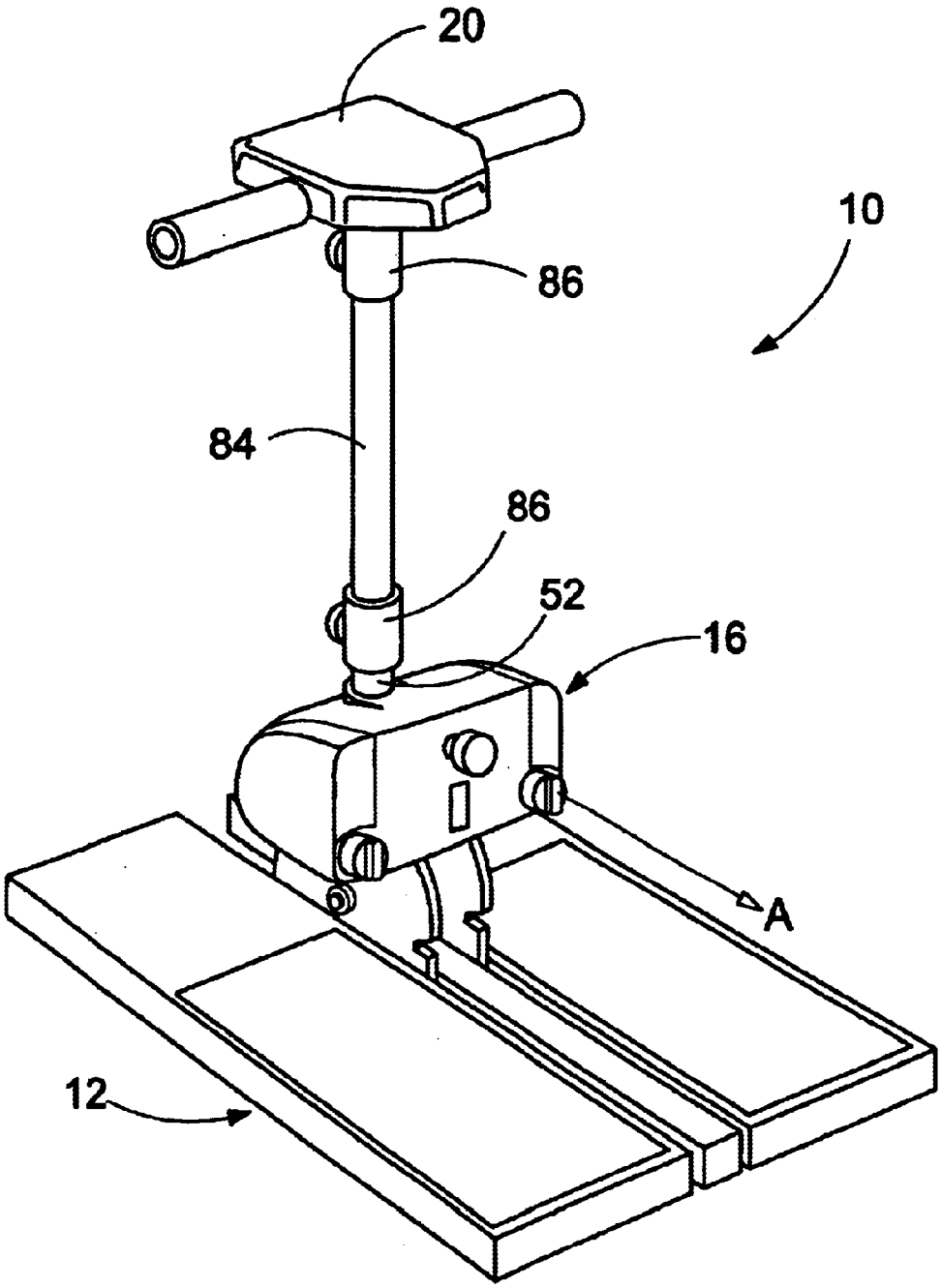
FIG. 5 is an illustrative perspective view of an alternative arrangement of the present invention portable personal training and exercise device with a cable and pulley mechanism.

Referring to FIG. 5, there is shown the present invention portable personal training and exercise device 10 used in an alternative configuration for exercising a user's leg or other muscles. In this configuration, the attachment pole 82 is removed and the cable and pulley assembly 16 is attached to the base tube 52 and the seat 20 is attached to the top of the extension pole 84.

Figure 6:
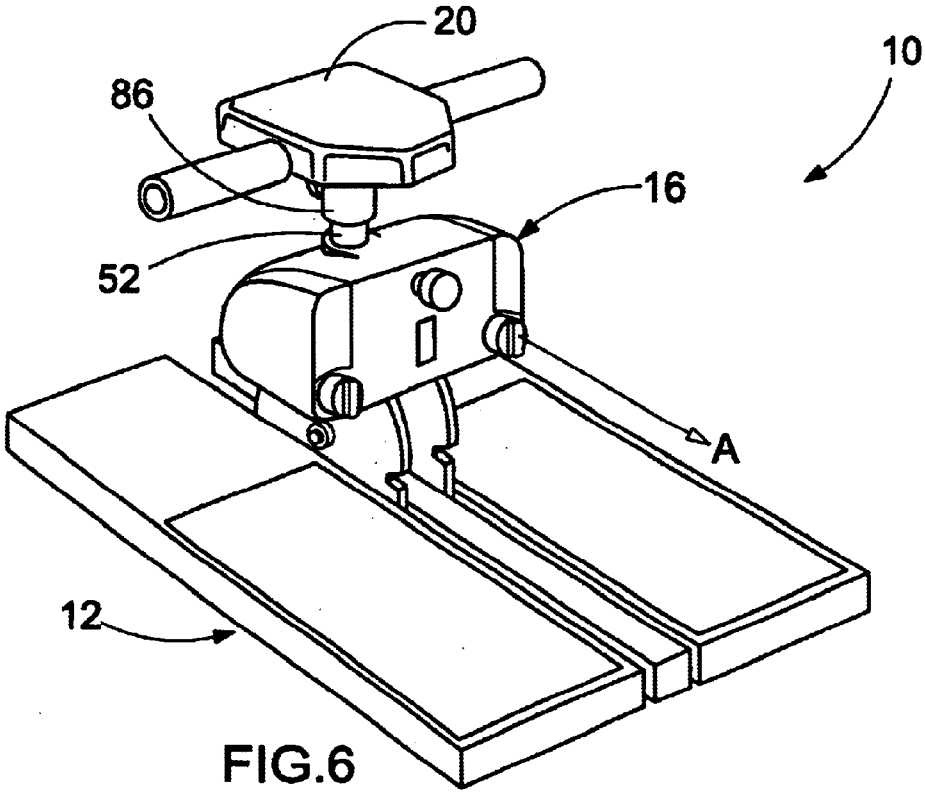
FIG. 6 is an illustrative perspective view of another alternative arrangement of the present invention portable personal training and exercise device with a cable and pulley mechanism.

Referring to FIG. 6, there is shown the present invention portable personal training and exercise device 10 used in another alternative configuration for exercising a user's leg or other muscles. In this configuration, the extension pole 84 is further removed with the cable and pulley assembly 16 is attached to the base tube 52 and the seat 20 is also attached to the top of the base tube 52.

Figure 7:
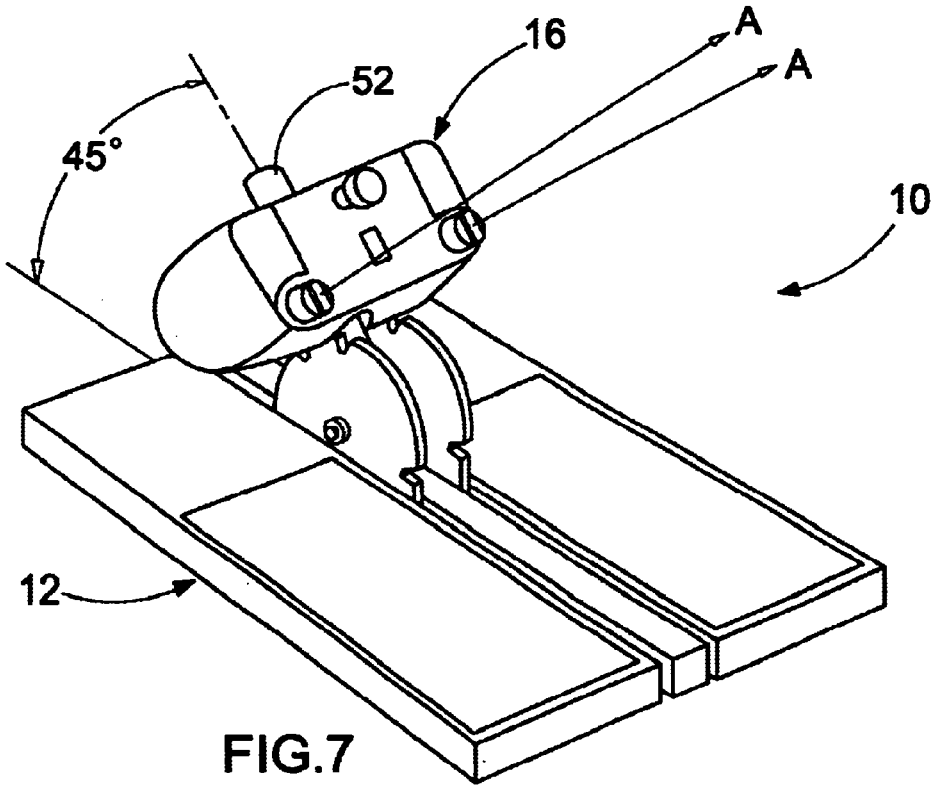
FIG. 7 is an illustrative perspective view of a further alternative arrangement of the present invention portable personal training and exercise device with a cable and pulley mechanism.

Referring to FIG. 7, there is shown the present invention portable personal training and exercise device 10 used in still another alternative configuration for exercising various muscles of a user. In this configuration, the seat 20 is removed with the cable and pulley assembly 16 attached to the base tube 52 which is in turn tilted to approximately a 45 degree angle so that the cables of the cable and pulley assembly 16 may be pulled towards a wide range of upward directions.

Figure 8:
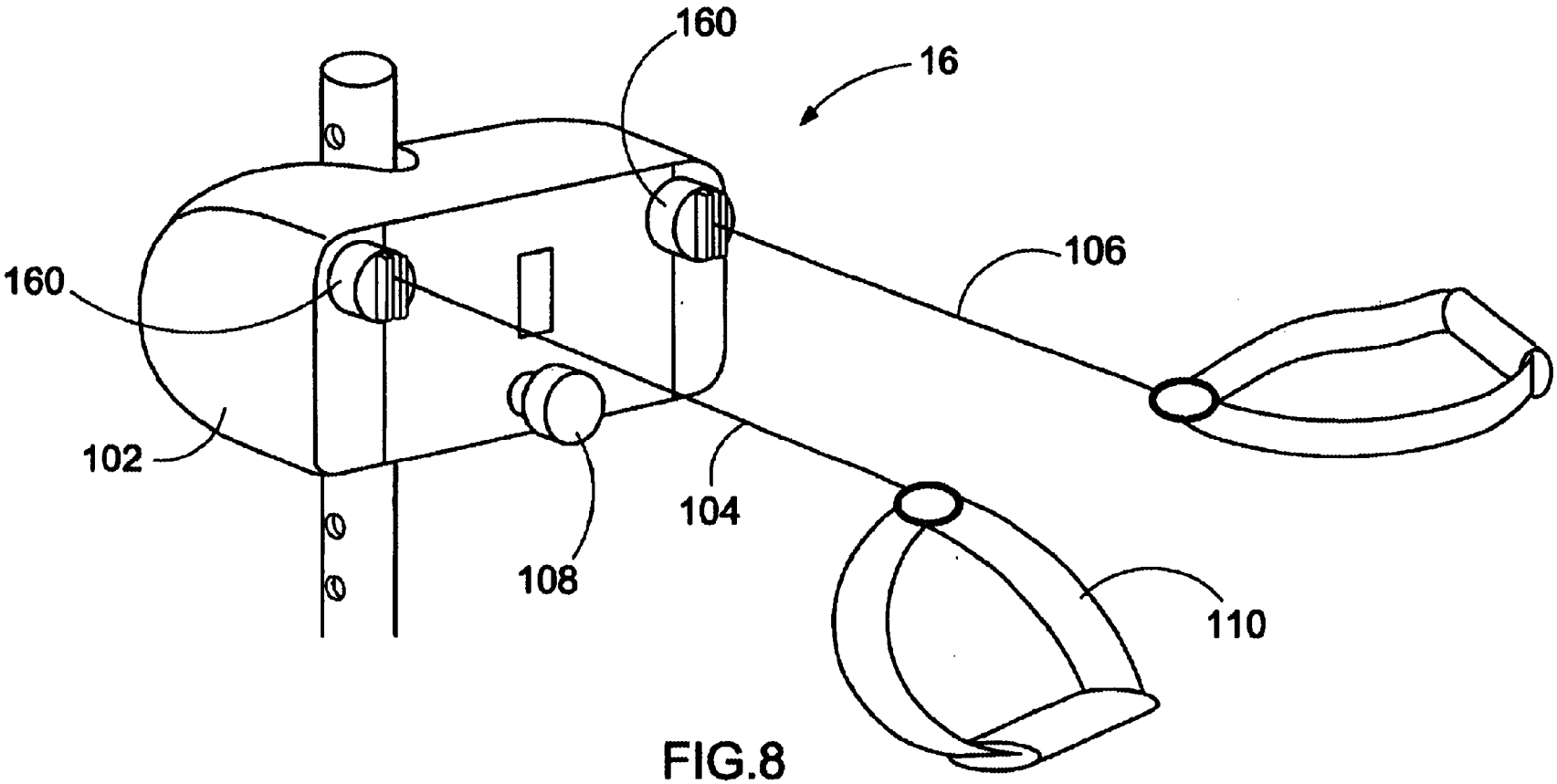
FIG. 8 is an illustrative perspective view of the cable and pulley assembly of the present invention portable personal training and exercise device with a cable and pulley mechanism.

As shown in FIG. 8, the cable and pulley assembly 16 of the present invention portable personal training and exercise device 10 has a housing 102 for containing a cable and pulley mechanism that provides resistant forces to the two cables 104 and 106. The user can adjust the resistance of the cables by turning the knob 108. Straps or holding bands 110 are provided at the end of the cables 104 and 106 for the user to hold on and pull the cables. The user can exercise various muscles of his or her body by pulling the cables towards different directions.

Figure 9:
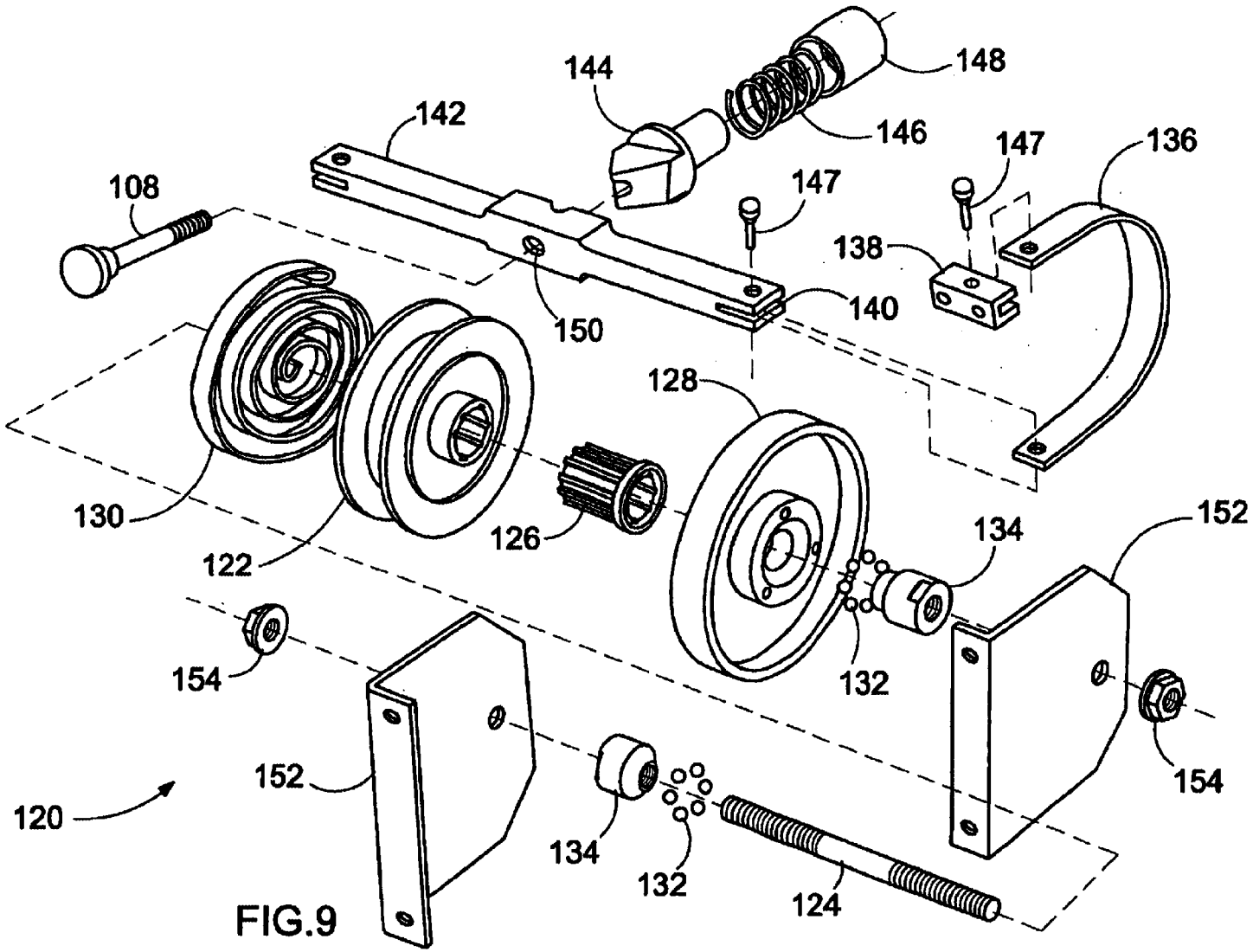
FIG. 9 is an exploded illustrative perspective view of the internal components and arrangement of the cable and pulley assembly of the present invention portable personal training and exercise device with a cable and pulley mechanism.
Figure 10:
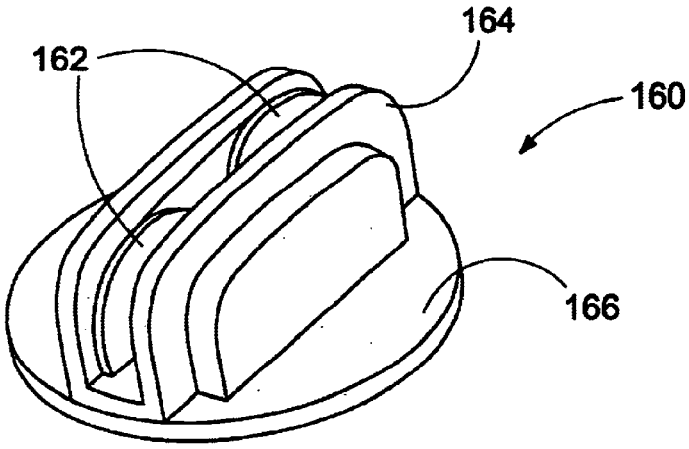
FIG. 10 is an illustrative perspective view of the multi-direction cord guide unit of the cable and pulley assembly of the present invention portable personal training and exercise device with a cable and pulley mechanism.
Figure 11:
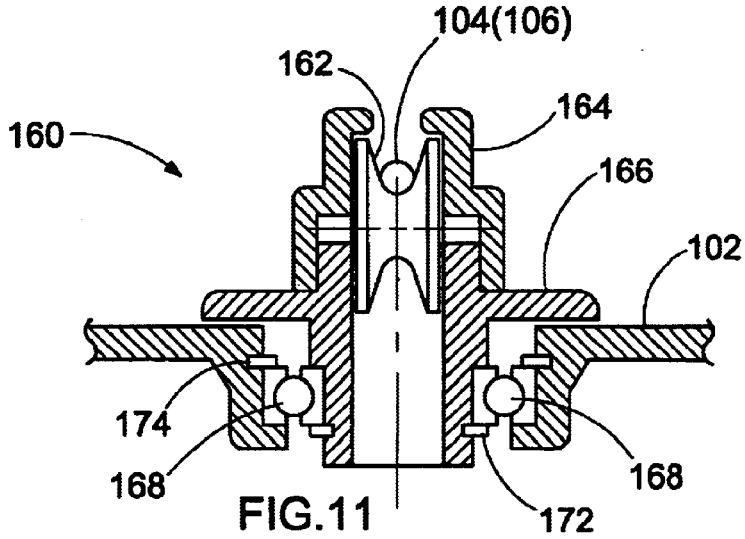
FIG. 11 is a cross-sectional view of the multi-direction cord guide unit of the cable and pulley assembly of the present invention portable personal training and exercise device with a cable and pulley mechanism.
Figure 12:
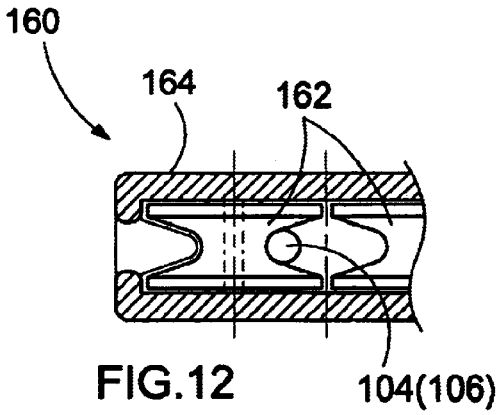
FIG. 12 is a partial cross-sectional view of the multi-direction cord guide unit of the cable and pulley assembly of the present invention portable personal training and exercise device with a cable and pulley mechanism.

Referring to FIG. 9, there is shown the internal assembly of the cable and pulley mechanism 120. The cable and pulley mechanism 120 includes two coaxial pulleys 122 that are stacked around a common single stationary shaft 124. In the drawings only one pulley assembly is shown because the arrangement of the two pulleys are symmetric and otherwise identical. Therefore only one of the two pulleys 122 will be described here.

The pulley 122 is mounted on a gear hub 126 which is similar to a bicycle gear hub which allows the pulley 122 to rotate about the shaft 124 in both the clockwise and the counterclockwise directions. A brake wheel 128 is mounted on one side of the pulley 122 and a clock spring 130 is mounted on the other side of the pulley 122. The inside end of the clock spring 130 is connected to outer rim of the gear hub 126, and the outside end of the clock spring 130 is connected to the housing 102 of the cable and pulley assembly 16. This arrangement allows the pulley 122 to rewind the cord 104 onto the pulley 122 at the urging of the clock spring 130.

The center of the brake wheel 128 is connected to the other side of the pulley 122 with a ridged circle in the middle that fits inside the inner socket of the gear hub 126, which allows the brake wheel to rotate only in one direction. Ball bearings 132 and ball bearing retainer nuts 134 are used to mount the gear hub 126 on the shaft 124.

A brake band 136 is suspended around the brake wheel 128. One end of the brake band 136 is anchored to the housing by an anchor piece 138, and the other end of the brake band 136 is inserted into an end slot 140 of a tension equalizing bar 142 and retained therein by a fastened screw 144. The tension equalizing bar 142 is used to maintain a balance between and uniformity of the two brake wheels 128.

The cable and pulley mechanism 120 further includes a tension adjustment unit which includes the adjustment knob 108, a fulcrum 144, a compression spring 146 and an end nut 148. The adjustment knob 108 is inserted through a middle hole 150 of the tension equalizing bar 142, and further through the fulcrum 144 and the compression spring 146 and finally threads into the end nut 148. Turning the knob 108 in one direction will increase the tension of the brake band 136 which in turn increases the resistance on the cord 104, and turning the knob 108 in the opposite direction will decrease the tension of the brake band 136 which in turn decreases the resistance on the cord 104. This allows the user to set the resistance force of the cords 104 at an appropriate level suitable to the user.

The cable and pulley mechanism 120 is mounted inside the housing 102 of the cable and pulley assembly 16 by a pair of end plates 152 which supports the shaft 124. The two opposite ends of the shaft 124 are fastened by shaft nuts 154.

Referring to FIGS. 8, 10, 11 and 12, the cable and pulley assembly 16 further includes two multi-direction guide units 160. Each multi-direction guide unit 160 is mounted on the housing 102 of the cable and pulley assembly at the exit opening of one of the pulley cords 104 and 106. Each multi-direction guide unit 160 includes two small pulleys 162, a top cover 164, and a swivel base 166. The swivel base is mounted at a cord exit opening of the housing 102 of the cable and pulley assembly 16 by ball bearings 168 and retained thereon by an inner retaining ring 172 and an outer retaining ring 174, which allow the swivel base 166 to rotate 360° around the cord exit opening to provide multi-direction guide to the cord 104 (or 106). This arrangement allows the cords 104 and 106 to be pulled by the user in any direction with reduced friction.

Figure 13:
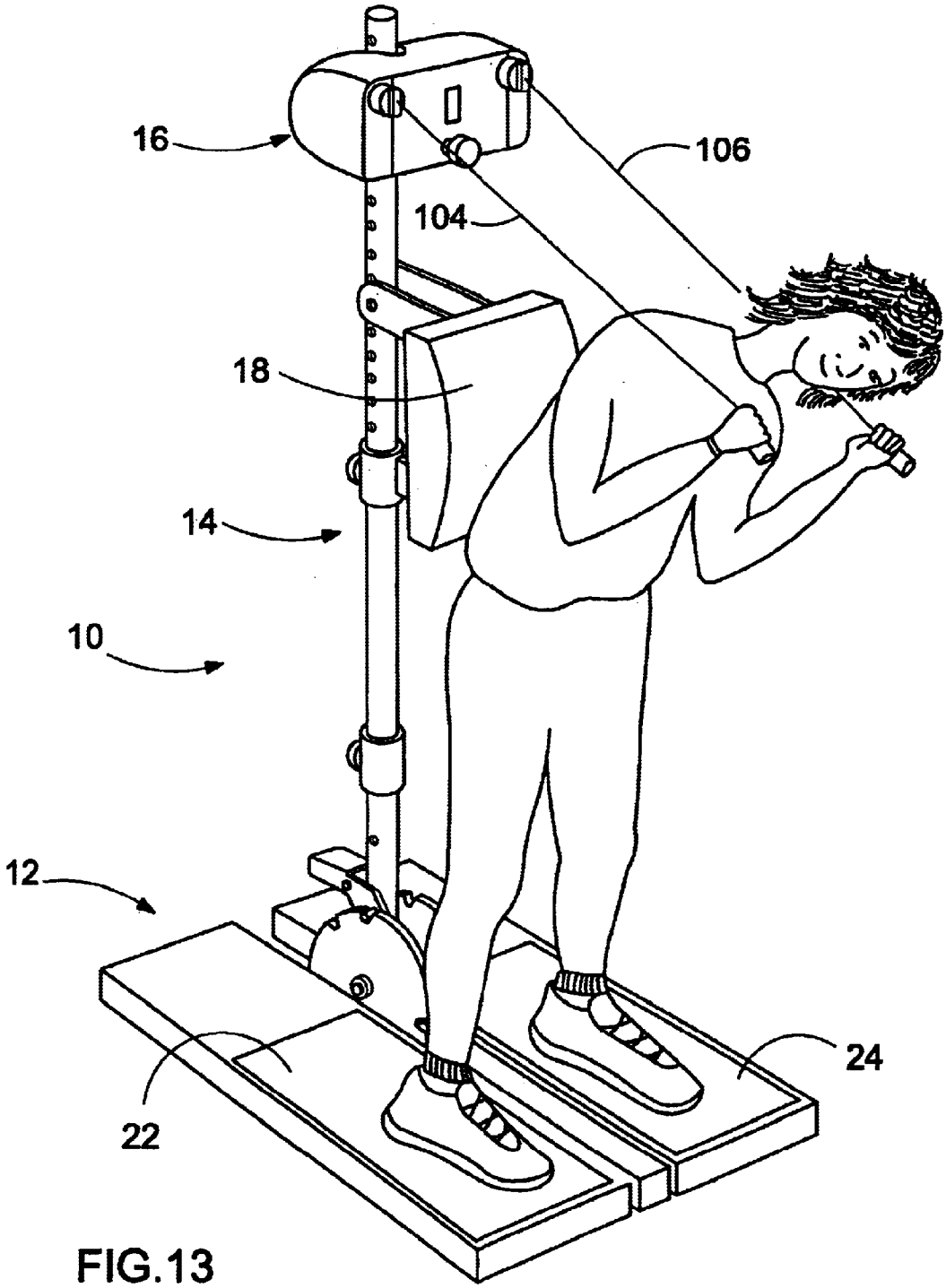
FIG. 13 is an illustrative perspective view showing one possible mode of operation of the present invention portable personal training and exercise device with a cable and pulley mechanism.

Referring to FIG. 13, there is illustrated one of the many possible uses of the present invention portable personal training and exercise device 10. As the user standing on the platforms 22 and 24 of the base assembly 12, the user may have his back supported by the body support 18 attached to the pole assembly 14 while pulling on the cords 104 and 106 of the cable and pulley assembly 16. This particular forward bending exercise is a unique option offered by the present invention portable personal training and exercise device 10 and is not available with most conventional exercise devices.

Referring back to FIGS. 1 and 2, when the present invention portable personal training and exercise device 10 is not in use, it can folded into a low profile by depressing the tilt lever 54 and rotating the pole assembly 14 to a horizontal position with the locking pin 70 rests in the notches 60 (at 180°) of the tilt plates 32 and 34 which locks the pole assembly 14 at the horizontal position for easy storage.

The present invention portable personal training and exercise device 10 has many advantages. It utilizes a cable and pulley mechanism which is easy to operate and maintain. It further offers many desirable exercise options with a quick and easy adjustability of the resistance force on the pulley cords. It is also lightweight, compact, and relatively inexpensive to produce.

Defined in detail, the present invention is a portable personal training and exercise device, comprising: (a) a base assembly having two parallel main platforms and a tilt mechanism assembled between and interconnecting the two parallel main platforms; (b) the tilt mechanism having a pair of tilt plates held upright in a spaced apart parallel relationship with a base tube pivotally mounted therebetween, each tilt plate having a semi-circular upper rim with multiple notches located at different degrees; (c) the tilt mechanism also having a tilt lever mounted on the base tube for moving a locking pin which can engage with the notches on the upper rims of the tilt plates for locking the base tube in different orientations including at least a vertical orientation; (d) a pole assembly having at least one extension pole, at least one attachment pole with attachment holes at regular intervals, and at least two connection sleeves for connecting the at least one extension pole to the base tube of the base assembly and connecting the at least one attachment pole to the at least one extension pole; (e) a cable and pulley assembly having a housing mounted on the attachment pole of the pole assembly for housing a cable and pulley mechanism therein; (f) the cable and pulley mechanism having two coaxial pulleys stacked around a common single stationary shaft, each pulley mounted on a gear hub and having a clock spring attached on one side of the pulley for rewinding a cord onto the pulley and a brake wheel attached on the opposite side of the pulley for resisting the rotation of the pulley; (g) the cable and pulley assembly further having a tension adjustment unit with an adjustment knob for adjusting the resistance of the pulleys from outside of the housing of the cable and pulley assembly; and (h) the cable and pulley assembly further having two multi-direction guide units mounted on the housing of the cable and pulley assembly for allowing the pulley cords to be pulled in multiple directions with reduced friction; (i) whereby a user may pull the cord of the pulleys for exercising various muscles of the user and adjust the resistance force of the cord at an appropriate level suitable to the user.

Defined broadly, the present invention is a portable personal training and exercise device, comprising: (a) a base assembly having two parallel main platforms and a tilt mechanism for holding a pivotally mounted base tube in different orientations including at least a vertical orientation; (b) a pole assembly having at least one pole and at least one connection sleeve for connecting the at least one pole to the base tube of the base assembly; (c) a cable and pulley assembly having a housing mounted on the at least one pole of the pole assembly for housing a cable and pulley mechanism therein; (d) the cable and pulley mechanism having two coaxial pulleys rotatably mounted on a common single stationary shaft, each spring biased for rewinding a cord onto the pulley; and (e) the cable and pulley assembly further having a tension adjustment unit with an adjustment knob for adjusting the resistance of the pulleys from outside of the housing of the cable and pulley assembly; (f) whereby a user may pull the cord of the pulleys for exercising various muscles of the user and adjust the resistance force of the cord at an appropriate level suitable to the user.

Defined more broadly, the present invention is a portable personal training and exercise device, comprising: (a) a base assembly having a platform; (b) a pole assembly mounted to the platform; (c) the base assembly further having a tilt mechanism for holding the pole assembly in different orientations; (d) a cable and pulley assembly attached to the pole assembly and having two coaxial pulleys rotatably mounted on a common single stationary shaft, each spring biased for rewinding a cord onto the pulley; and (e) the cable and pulley assembly further having a tension adjustment unit for adjusting the resistance of the pulleys; (f) whereby a user may pull the cord of the pulleys for exercising various muscles of the user and adjust the resistance force of the cord at an appropriate level suitable to the user.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention.

What is claimed is:

1. A portable personal training and exercise device, comprising:

a. a base assembly having two parallel main platforms and a tilt mechanism assembled between and interconnecting the two parallel main platforms;

b. said tilt mechanism having a pair of tilt plates held upright in a spaced apart parallel relationship with a base tube pivotally mounted therebetween, each tilt plate having a semi-circular upper rim with multiple notches located at different degrees;

c. said tilt mechanism also having a tilt lever mounted on said base tube for moving a locking pin which can engage with the notches on said upper rims of said tilt plates for locking said base tube in different orientations including at least a vertical orientation;

d. a pole assembly having at least one extension pole, at least one attachment pole with attachment holes at regular intervals, and at least two connection sleeves for connecting the at least one extension pole to said base tube of said base assembly and connecting the at least one attachment pole to the at least one extension pole;

e. a cable and pulley assembly having a housing mounted on said at least one attachment pole of said pole assembly for housing a cable and pulley mechanism therein;

f. said cable and pulley mechanism having two coaxial pulleys stacked around a common single stationary shaft, each pulley mounted on a gear hub and having a clock spring attached on one side of the pulley for rewinding a cord onto the pulley and a brake wheel attached on the other opposite side of the pulley for resisting the rotation of the pulley;

g. said cable and pulley assembly also having a tension adjustment unit with an adjustment knob for adjusting the resistance of said pulleys from outside of said housing of said cable and pulley assembly; and h. said cable and pulley assembly further having two multi-direction guide units mounted on said housing of said cable and pulley assembly for allowing said pulley cords to be pulled in multiple directions with reduced friction;

i. whereby a user may pull said cord of said pulleys for exercising various muscles of said user and adjust the resistance force of said cord at an appropriate level suitable to the user.

2. The portable personal training and exercise device as claimed in claim 1, wherein said base assembly further comprises a narrow center platform assembled between said two main platforms for filling a gap therebetween.

3. The portable personal training and exercise device as claimed in claim 2, wherein said base assembly further comprises two spacer strips each assembled between one of said two main platforms and said center platform.

4. The portable personal training and exercise device as claimed in claim 1, wherein said notches on said upper rims of said tilt plates are located at 45°, 90° and 180° angles.

5. The portable personal training and exercise device as claimed in claim 1, wherein said locking pin is spring biased to remain inside said notches on said upper rims of said tilt plates, unless moved by said tilt lever, to hold said base tube in a respective orientation.

6. The portable personal training and exercise device as claimed in claim 1, wherein said cable and pulley mechanism further comprises two brake bands respectively suspended around said two brake wheels to apply resistance thereon.

7. The portable personal training and exercise device as claimed in claim 6, wherein said tension adjustment unit of said cable and pulley mechanism further comprises a spring biased tension equalizing bar for maintaining a balance between and uniformity of said two brake wheels.

8. The portable personal training and exercise device as claimed in claim 7, wherein each brake band has one end anchored on said housing of said cable and pulley assembly and an opposite end attached to one of two opposite ends of said tension equalizing bar.

9. The portable personal training and exercise device as claimed in claim 1, further comprising a body support attachable to said attachment pole of said pole assembly for supporting a body part of said user when said user is using said portable personal training and exercise device.

10. The portable personal training and exercise device as claimed in claim 1, further comprising a seat attachable to said extension pole of said pole assembly or said base tube of said base assembly for allowing said user to sit on the seat when using said portable personal training and exercise device.

11. A portable personal training and exercise device, comprising:

a. a base assembly having two parallel main platforms and a tilt mechanism for holding a pivotally mounted base tube in different orientations including at least a vertical orientation;

b. a pole assembly having at least one pole and at least one connection sleeve for connecting the at least one pole to said base tube of said base assembly;

c. a cable and pulley assembly having a housing mounted on said at least one pole of said pole assembly for housing a cable and pulley mechanism therein;

d. said cable and pulley mechanism having two coaxial pulleys rotatably mounted on a common single stationary shaft, each spring biased for rewinding a cord onto the pulley; and e. said cable and pulley assembly further having a tension adjustment unit with an adjustment knob for adjusting the resistance of said pulleys from outside of said housing of said cable and pulley assembly;

f. whereby a user may pull said cord of said pulleys for exercising various muscles of said user and adjust the resistance force of said cord at an appropriate level suitable to the user.

12. The portable personal training and exercise device as claimed in claim 11, wherein said base assembly further comprises a narrow center platform assembled between said two main platforms for filling a gap therebetween.

13. The portable personal training and exercise device as claimed in claim 11, wherein said tilt mechanism further comprises a pair of tilt plates held upright in a spaced apart parallel relationship between said two main platforms with said base tube pivotally mounted therebetween, each tilt plate having a semi-circular upper rim with multiple notches located at different degrees.

14. The portable personal training and exercise device as claimed in claim 13, wherein said tilt mechanism further comprises a tilt lever mounted on said base tube for moving a locking pin which can engage with said notches on said upper rims of said tilt plates for locking said base tube in different orientations.

15. The portable personal training and exercise device as claimed in claim 14, wherein said locking pin is spring biased to remain inside said notches on said upper rims of said tilt plates, unless moved by said tilt lever, to hold said base tube in a respective orientation.

16. The portable personal training and exercise device as claimed in claim 11, wherein said cable and pulley mechanism further comprises two brake wheels respectively attached to said two pulleys, and two brake bands respectively suspended around said two brake wheels to apply resistance thereon.

17. The portable personal training and exercise device as claimed in claim 16, wherein said tension adjustment unit of said cable and pulley mechanism further comprises a spring biased tension equalizing bar for maintaining a balance between and uniformity of said two brake wheels.

18. The portable personal training and exercise device as claimed in claim 17, wherein each brake band has one end anchored on said housing of said cable and pulley assembly and an opposite end attached to one of two opposite ends of said tension equalizing bar.

19. The portable personal training and exercise device as claimed in claim 11, wherein said cable and pulley assembly further comprises two multi-direction guide units mounted on said housing of said cable and pulley assembly for allowing said pulley cords to be pulled in multiple directions with reduced friction.

20. The portable personal training and exercise device as claimed in claim 11, further comprising a body support attachable to said at least one pole of said pole assembly for supporting a body part of said user when said user is using said portable personal training and exercise device.

21. The portable personal training and exercise device as claimed in claim 11, further comprising a seat attachable to said at least one pole of said pole assembly or said base tube of said base assembly for allowing said user to sit on the seat when using said portable personal training and exercise device.

22. A portable personal training and exercise device, comprising:

a. a base assembly having a platform;

b. a pole assembly mounted to said platform;

c. said base assembly further having a tilt mechanism for holding said pole assembly in different orientations;

d. a cable and pulley assembly attached to said pole assembly and having two coaxial pulleys rotatably mounted on a common single stationary shaft, each spring biased for rewinding a cord onto the pulley; and e. said cable and pulley assembly further having a tension adjustment unit for adjusting the resistance of said pulleys;

f. whereby a user may pull said cord of said pulleys for exercising various muscles of said user and adjust the resistance force of said cord at an appropriate level suitable to the user.

23. The portable personal training and exercise device as claimed in claim 22, wherein said base assembly comprises two parallel main platforms.

24. The portable personal training and exercise device as claimed in claim 23, wherein said tilt mechanism further comprises a pair of tilt plates held upright in a spaced apart parallel relationship between said two main platforms, each tilt plate having a semi-circular upper rim with multiple notches located at different degrees.

25. The portable personal training and exercise device as claimed in claim 24, wherein said tilt mechanism further comprises a tilt lever mounted on a base tube connected with said pole assembly for moving a locking pin which can engage with said notches on said upper rims of said tilt plates for locking said pole assembly in different orientations.

26. The portable personal training and exercise device as claimed in claim 25, wherein said locking pin is spring biased to remain inside said notches on said upper rims of said tilt plate, unless moved by said tilt lever, to hold said pole assembly in a respective orientation.

27. The portable personal training and exercise device as claimed in claim 22, wherein said cable and pulley mechanism further comprises two brake wheels respectively attached to said two pulleys, and two brake bands respectively suspended around said two brake wheels to apply resistance thereon.

28. The portable personal training and exercise device as claimed in claim 27, wherein said tension adjustment unit of said cable and pulley mechanism further comprises a spring biased tension equalizing bar for maintaining a balance between and uniformity of said two brake wheels.

29. The portable personal training and exercise device as claimed in claim 28, wherein each brake band has one end fixedly anchored and an opposite end attached to one of two opposite ends of said tension equalizing bar.

30. The portable personal training and exercise device as claimed in claim 22, wherein said cable and pulley assembly further comprises two multi-direction guide units mounted on said housing of said cable and pulley assembly for allowing said pulley cords to be pulled in multiple directions with reduced friction.

31. The portable personal training and exercise device as claimed in claim 22, further comprising a body support attachable to said pole assembly for supporting a body part of said user when said user is using said portable personal training and exercise device.

32. The portable personal training and exercise device as claimed in claim 22, further comprising a seat attachable to said pole assembly for allowing said user to sit on the seat when using said portable personal training and exercise device.

* * * * *